US007497585B2

(12) United States Patent
Yu

(10) Patent No.: US 7,497,585 B2
(45) Date of Patent: Mar. 3, 2009

(54) DYNAMO-POWERED WEARABLE LIGHT ASSEMBLY

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 52 days.

(21) Appl. No.: 11/194,185

(22) Filed: Aug. 1, 2005

(65) Prior Publication Data

US 2007/0025102 A1 Feb. 1, 2007

(51) Int. Cl.
*F21V 21/084* (2006.01)

(52) U.S. Cl. ..... 362/105; 362/192

(58) Field of Classification Search ..... 362/103–108, 362/192–193
See application file for complete search history.

(56) References Cited

U.S. PATENT DOCUMENTS 4,701,835 A * 10/1987 Campagnuolo et al. ..... 362/192
5,358,461 A * 10/1994 Bailey, Jr. ..... 482/2
6,659,617 B1 * 12/2003 Michael ..... 362/104
6,959,999 B2 * 11/2005 Lee ..... 362/192
7,281,826 B2 * 10/2007 Huang ..... 362/398

* cited by examiner

*Primary Examiner*—Sandra O'Shea
*Assistant Examiner*—Jason Moon Han
(74) *Attorney, Agent, or Firm*—Gifford, Krass, Sprinkle, Anderson & Citkowski, P.C.

(57) ABSTRACT

A light assembly includes an electrically powered light source, a hand-powered electric dynamo and a rechargeable battery. The hand-powered electric dynamo has the capability to power the light source and recharge the battery. A fastener is used to detachably mount the light source, dynamo and battery to the user. In providing the user with a detachably mounted light assembly having the capability to recharge the batteries thereon, a more reliable light source is provided for the user working under extreme and often dangerous conditions.

17 Claims, 1 Drawing Sheet

DYNAMO-POWERED WEARABLE LIGHT ASSEMBLY

FIELD OF THE INVENTION

The present invention in general relates to a user-worn lamp and in particular to a user-worn lamp powerable by a user-worn dynamo.

BACKGROUND OF THE INVENTION

An individual will mount a lamp to their body in a variety of instances when entering an environment under low ambient light conditions. In order to work effectively in such environments, lamps have been designed to mount to various body portions of an individual to afford hands-free operation. To this end, lamps are known to the art that mount to the head, chest or belt of a user. Such lamps are routinely found in diverse settings that illustratively include mining, cave exploration, building salvage, subterranean excavation and construction, hiking, fishing, and wildlife management. Such conventional lamps are battery powered. The use of batteries to power a lamp worn by a user represents both a source of potential danger and an inconvenience. The reduction in light intensity associated with a failing battery or the catastrophic loss of illumination can jeopardize the safety of a user in a number of settings. Replacement of batteries in such a setting is highly impractical even if the user carries additional batteries. The use of replacement batteries or a backup set of batteries increases the weight burden a user must carry.

Thus, there exists a need for a user-worn lamp including a dynamo that facilitates field or emergency regeneration of the lamp.

SUMMARY OF THE INVENTION

A light assembly includes an electrically powered light source, a hand-powered electric dynamo and a rechargeable battery detachably mounted to a user. The dynamo and the battery are electrically connected to the light source. Use of the hand-powered electric dynamo allows for recharging the battery or powering the light source, or in the alternative, for recharging the battery and powering the light source simultaneously. The light source may consist of a plurality of light sources, said light sources being the same color or different colors. A gearing is provided to assist the user in producing an appropriate rotation speed for the dynamo. A voltage step-up or step-down is provided to ensure an appropriate voltage is provided to the light source and the rechargeable battery. With the light source, hand-powered dynamo and battery of the present invention detachably mounted on the user, a more reliable light source is provided.

DESCRIPTION OF THE PREFERRED EMBODIMENTS

The present invention has utility as a user-mounted light source powerable with a dynamo. A dynamo as used herein is synonymous with an electrical generator. Representative manifestations of the present invention include user-mounted light sources for miners, cavers, hikers and rescue workers.

Using a dynamo to power a light source, or in the alternative to recharge a battery that powers the light source, reduces the need for a user to carry additional batteries. The dynamo also affords a more reliable light assembly to the user that requires a light source under extreme and often dangerous conditions, as compared to conventional light sources.

The invention includes a dynamo, at least one light source, an electrical communication therebetween and a coupling for the securement to the user. In a preferred embodiment a hand crank powers the dynamo, with the dynamo recharging a battery that powers the light source. However, other methods to power a dynamo may be used, including but not limited to electrical and mechanical driven motors.

Figure 1:
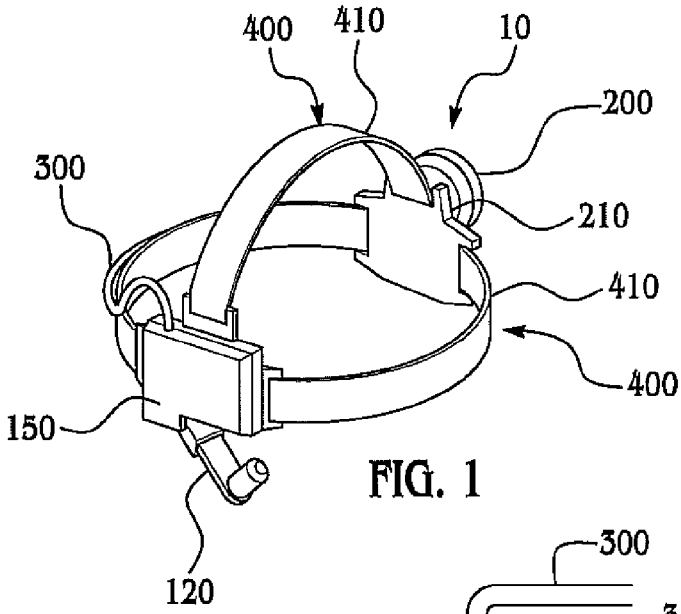
FIG. 1 is a perspective view of an inventive wearable light assembly.
Figure 2:
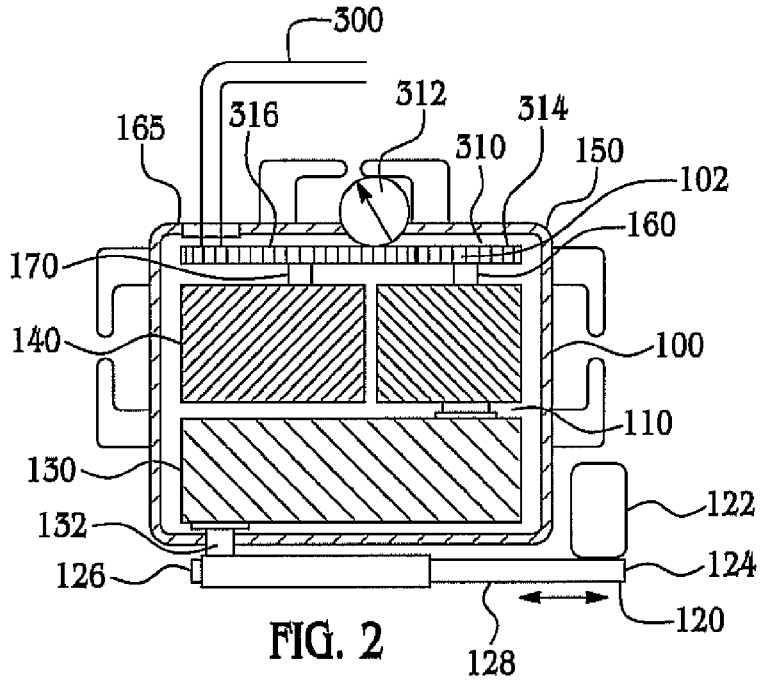
FIG. 2 is a sectional view of a dynamo housing depicted in FIG. 1.

Referring now to the figures, an exemplary preferred embodiment of an inventive light assembly is shown in FIG. 1 generally at 10. FIG. 2 shows a sectional view of a housing 150 depicted in FIG. 1. A dynamo 100 generates electricity by rotation of a dynamo shaft 110, with the dynamo shaft powered by the rotation of a dynamo crank 120.

The dynamo crank 120 has a first end 124 and a second end 126 oppositely disposed from the first end 124. A dynamo crank handle 122 is mechanically coupled to the first end 124 of the dynamo crank 120. The dynamo crank 120 is mechanically coupled to a gearing inlet shaft 132 through the second end 126. Preferably, the dynamo crank 120 has a telescoping handle that affords an increase of the crank length and thereby an increase in the torque applied to gearing inlet shaft 132. The gearing inlet shaft 132 is mechanically coupled to a gearing 130.

Figure 3:
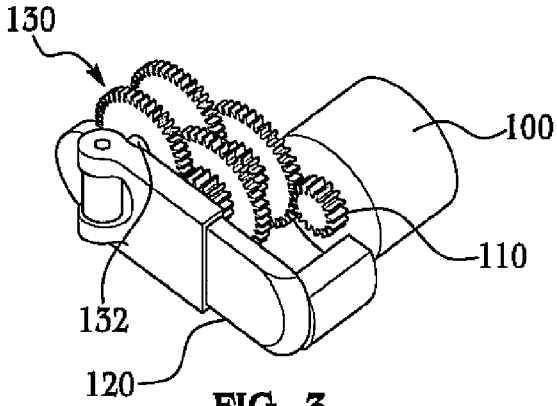
FIG. 3 is a perspective view of a gearing operative in the present invention.

A perspective view of the gearing 130 is shown in FIG. 3. The gearing 130 has at least one gear, and preferably has more than one gear. The gearing 130 affords rotation of a dynamo shaft 110. The dynamo shaft 110 is mechanically coupled to a dynamo 100. The gearing 130 is preferably adjustable and produces at least one ratio between the rotational speed of the gearing inlet shaft 132 and the rotational speed of the dynamo shaft 110 not equal to unity during the operation of the invention, and in this manner the gearing 130 generates appropriate revolutions per minute (RPM) for the dynamo 100.

In operation, the user grips the dynamo crank handle 122 and rotates the dynamo crank 120 to cause rotation of the gearing inlet shaft 132. Rotation of the gearing inlet shaft 132 induces rotation of the gearing 130, the dynamo shaft 110 and the dynamo 100. Rotation of the dynamo 100 produces electricity.

It is appreciated that dynamo shaft 110 can be rotated by other suitable devices. For example, stored energy controllably released from a wound tension spring can power the dynamo 100. In the alternative, a ratchet handle coupled to the gearing inlet shaft 132 or the dynamo shaft 110 can power dynamo 100.

The light assembly 10 preferably includes a control logic board 310 connected to the dynamo 100 through a dynamo-control logic board contact 160. The control logic board 310 is electrically connected to a battery 140 and a light source 200 through a battery-control logic board contact 170 and an electrical lead 300, respectively. The dynamo-control logic board contact 160, battery-control logic board contact 170 and electrical lead 300 electrically connect the battery 140 and the light source 200 to the dynamo 100. It is appreciated that the present invention electively has an adapter 165 permitting non-manual battery recharge. Alternative power sources illustratively include line power, solar cell electricity or fuel cell electricity.

In addition to serving as an electrical connection between the dynamo 100, battery 140 and light source 200, the control logic board 310 optionally affords other functions such as monitoring the battery charge status of battery 140 to ensure the battery does not overcharge; or indicating the current power level of the battery 140. Optionally, the control logic board 310 also affords a voltage increase or voltage decrease subcircuit 102 that modifies the voltage of the electricity provided to the battery 140 or the light source 200.

A switch 312 allows the user to select whether the electricity generated by the dynamo 100 is directed to recharge the battery 140 or to power the light source 200. It is appreciated that the present invention optionally operates without the battery 140. It is also appreciated that the present invention optionally uses more than one battery and the switch 312 permits the user to direct the electricity generated by the dynamo 100 to recharge one battery while a different battery is used to power the light source 200.

The present invention optionally operates with a non-rechargeable battery. The switch 312 allows the user to direct the electricity generated by the dynamo 100 to power the light source 200 after the non-rechargeable battery has failed, or in the alternative, to power the light source 200 initially in order to preserve the non-rechargeable battery. The switch 312 is a stand alone switch, or alternately is included within the logic control board 310.

The light source 200 includes at least one light element. The light source is of a type that includes but is not limited to an incandescent bulb, a fluorescent tube, a light emitting diode (LED), an ultraviolet (UV) fluorescent tube, an UV LED, a laser emitting diode or a cold cathode ray tube. When multiple light producing elements are present, the elements all produce the same light emission spectra, or in the alternative, different light emission spectra. Light source 200 may also be a strobe light source. A preferred embodiment incorporates an activation switch 210 to activate and deactivate at least one of the light sources or any combination thereof. The activation switch 210 is a stand alone switch, or alternately is included within the logic control board 310.

A coupling 400 detachably couples a housing 150, the light source 200 and electric lead 300 to the user. The coupling 400 is depicted as a strap 410 in FIG. 1. Securement schemes to mount the present invention to a variety of apparel articles are well known to the art. In this way an inventive light source is secured to apparel articles illustratively including hardhats, helmets, armbands or belts. It is appreciated that the securement scheme, including coupling 400, holds the light source 200 in a fixed position.

A particular embodiment of the invention having been detailed herein, it is appreciated that changes and modifications may be made by those skilled in the art without departing from the invention in its broader aspects. The embodiments described herein are considered exemplary and not intended to limit the scope of the appended claims.

The invention claimed is:

1. A wearable light assembly comprising:

an electrically powered light source;

a hand-powered electric dynamo, said dynamo being electrically connected to said light source;

a hand crank mechanically coupled to said dynamo through gearing, said gearing having a ratio between a rotational speed of said hand crank and a rotational speed of said dynamo of greater than one;

a coupling for detachably mounting said light source and said dynamo to a forehead of a user; and a rechargeable battery connected to said dynamo; and a switch having a plurality of positions, wherein said switch has a position to form an electrical connection selected from the group consisting of: from said dynamo to said light source; from said battery to said light source; from said dynamo to said battery; and from said dynamo simultaneously to said light source and said battery.

2. The light assembly of claim 1 wherein said light source has a plurality of light producing elements.

3. The light assembly of claim 2 further comprising a second switch, said second switch forming an electrical circuit between at least one of said plurality of light producing elements and said battery.

4. The light assembly of claim 3 further comprising a control logic board, said control logic board containing said switch and said second switch.

5. The light assembly of claim 4 wherein said logic board contains a voltage step-change subcircuit modifying a voltage delivered to said light source.

6. The light assembly of claim 1 wherein said hand crank has a telescoping handle.

7. The light assembly of claim 1 further comprising a housing containing said dynamo.

8. The light assembly of claim 7 wherein said housing further comprises the rechargeable battery electrically connected to said dynamo.

9. The light assembly of claim 1 wherein said coupling secures said light source in a fixed position on the user.

10. A light assembly comprising:

an electrically powered light source;

a hand-powered dynamo, said dynamo being electrically connected to said light source;

a battery, said battery electrically connected to said dynamo;

a gearing, said gearing having an inlet shaft and an outlet shaft and having a ratio between a rotational speed of said hand crank and a rotational speed of said dynamo of greater than one, wherein said outlet shaft is mechanically coupled to said dynamo;

a hand crank having a telescoping handle, said hand crank mechanically coupled to said inlet shaft of said gearing; a switch having a plurality of positions, wherein said switch has a position to form and electrical connection selected from the group consisting of: from said dynamo to said light source; from said battery to said light source; from said dynamo to said battery; and from said dynamo simultaneously to said light source and said battery; and a coupling, said coupling detachably mounting said light source, said dynamo, said battery, said gearing and said hand crank to a forehead of a user.

11. The light assembly of claim 10 wherein said battery is a rechargeable battery.

12. The light assembly of claim 10 wherein said light source has a plurality of light producing elements.

13. The light assembly of claim 12 further comprising a second switch, said second switch forming an electrical circuit between at least one of said plurality of light producing elements and said battery.

14. An invention as claimed in claim 13 further comprising a control logic board, said control logic board containing said switch and said second switch.

15. The invention claimed in claim 14 wherein said logic board contains a voltage step-change subcircuit modifying a voltage delivered to said light source.

16. The invention claimed in claim 10 wherein said coupling detachably mounts said light source in a fixed position on the user.

17. The invention claimed in claim 10 wherein said coupling detachably mounts said light source on a head of the user.

* * * * *